US008734946B2

(12) United States Patent
Bell et al.

(10) Patent No.: US 8,734,946 B2
(45) Date of Patent: May 27, 2014

(54) PRODUCT WITH TAILORED WETTABILITY

(75) Inventors: Steven Ernest John Bell, Belfast (GB); Iain Alexander Larmour, County Down (GB); Graham Charles Saunders, Belfast (GB)

(73) Assignee: The Queen's University of Belfast, Belfast (GB)

( * ) Notice: Subject to any disclaimer, the term of this patent is extended or adjusted under 35 U.S.C. 154(b) by 0 days.

(21) Appl. No.: 12/995,726

(22) PCT Filed: Jun. 2, 2009

(86) PCT No.: PCT/GB2009/050604
§ 371 (c)(1),
(2), (4) Date: Feb. 22, 2011

(87) PCT Pub. No.: WO2009/147428
PCT Pub. Date: Dec. 10, 2009

(65) Prior Publication Data

US 2011/0143119 A1 Jun. 16, 2011

(30) Foreign Application Priority Data

Jun. 3, 2008 (GB) ..... 0810039.8

(51) Int. Cl.
*B32B 5/16* (2006.01)

(52) U.S. Cl.
USPC ..... 428/402; 428/403; 428/407; 427/212; 427/216; 427/220

(58) Field of Classification Search
USPC ..... 428/402, 403, 407; 427/212, 216, 220
See application file for complete search history.

(56) References Cited

U.S. PATENT DOCUMENTS

| | | | | |
|---|---|---|---|---|
| 3,922,431 A | | 11/1975 | Radmacher et al. | |
| 4,104,197 A | * | 8/1978 | Heffler | 502/101 |
| 4,506,037 A | * | 3/1985 | Suzuki et al. | 521/82 |
| 5,603,815 A | * | 2/1997 | Lashmore et al. | 204/222 |
| 6,277,489 B1 | * | 8/2001 | Abbott et al. | 506/15 |
| 2006/0110537 A1 | * | 5/2006 | Huang et al. | 427/299 |

FOREIGN PATENT DOCUMENTS

| | | | | |
|---|---|---|---|---|
| EP | 1 568 800 | A1 | | 8/2005 |
| JP | 07165433 | A | | 6/1995 |
| JP | 9-278598 | A | | 10/1997 |
| JP | 11-97030 | A | | 4/1999 |
| RU | 2 126 311 | C1 | | 2/1999 |
| RU | 2 192 334 | C2 | | 11/2002 |
| WO | 95/26245 | A1 | | 10/1995 |
| WO | 9800256 | A | | 1/1998 |
| WO | WO98/00256 | | * | 1/1998 |
| WO | 2008035045 | A | | 3/2008 |
| WO | WO2008/035045 | | * | 3/2008 |

OTHER PUBLICATIONS

Larmour et al., "Sheets of Large Superhydrophobic Metal Particles Self Assembled on Water by the Cheerios Effect", Angewandte Chemie, (Jun. 23, 2008), vol. 47, No. 27, pp. 5043-5045.
Gao et al., "A Perfectly Hydrophobic Surface", J. Am. Chem. Soc., Polymer Science and Engineering Department, University of Massachusetts, (2006), vol. 128, pp. 9052-9053.
Steele et al., "Inherently Superoleophobic Nanocomposite Coatings by Spray Atomization", American Chemical Society, (2009), vol. 9, No. 1, pp. 501-505.
Moon et al.; "In situ sensing of metal ion adsorption to a thiolated surface using surface plasmon resonance spectroscopy"; Journal of Colloid and Interface Science; 2006; pp. 543-549; vol. 298.
Pang et al.; "An integrated study of dropwise condensation hear transfer on self-assembled organic surfaces through Fourier transform infra-red spectroscopy and ellipsometry"; International Journal of Heat and Mass Transfer; 2005; pp. 307-316; vol. 48.
Ma et al.; "Superhydrophobic surfaces"; Current Opinion in Colloid & Interface Science; 2006; pp. 193-202; vol. 11.
Zhang et al.; "Superhydrophobic surfaces: from structural control to functional application"; J. Mater. Chem.; 2008; pp. 621-633; vol. 18.

* cited by examiner

*Primary Examiner* — Leszek Kiliman
(74) *Attorney, Agent, or Firm* — The Webb Law Firm

(57) ABSTRACT

A product which at least partly comprises an agglomerate formed from a powder having a pre-determined wettability.

15 Claims, 3 Drawing Sheets

PRODUCT WITH TAILORED WETTABILITY

CROSS REFERENCE TO RELATED APPLICATIONS

Figure 1:
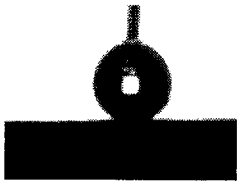

This application is a National Stage of International Application No. PCT/GB2009/050604, filed Jun. 2, 2009, which in turn claims the benefit under 35 U.S.C. §119 of United Kingdom Patent Application No. GB 0810039.8, filed Jun. 3, 2008, which is incorporated herein by reference in its entirety.

The present invention relates to a product at least partly comprising an agglomerate formed from a powder having a pre-determined wettability which can range from superhydrophobic to superhydrophilic for water and aqueous solutions and from completely non-wetting to fully wetting for other liquids, a product having a homogeneous outer layer having a tailored wettability, and processes therefor.

The extent to which a liquid wets the surface of a product is typically defined by the 'contact angle' which is the angle that a drop of liquid makes with the surface.

Due to its special importance much research has concentrated on water as the liquid, and this has led to the use of the term 'superhydrophobic' for surfaces which give contact angles larger than 150° with water. For a perfectly hydrophobic surface the contact angle should be 180°. A water drop applied to such a surface would roll freely, with apparently no friction.

There have been a wide range of approaches to the synthesis of superhydrophobic surfaces, and these include: the use of polyelectrolyte multilayers, sol-gels, self-assembly, plasma treatment, nanosphere lithography, carbon nanotube forests, raspberry-like particles, silica-based surfaces and chemical etching of glass and metal.

Due to difficulties in accurate visualization of the contact between liquid and surface, contact angle measurements are not straightforward, particularly at the extremes of the contact angle scale, i.e. 0° and 180°, but one method for preparation of a perfectly hydrophobic)($\theta$=180° surface has been claimed (L. Gao and T. J. McCarthy, Journal of the American Chemical Society, 2006, vol. 128, 9052-53). However, this method is not generally or industrially applicable as it is limited to silicon, works for only 70% of samples, and involves the use of expensive equipment for an oxygen plasma cleaning step.

WO2008/035045 describes coating a metallic article, such as a substrate or a powder. A substrate such as a ship's hull can be coated for direct use. A coated powder is described as useable to 'dope' a plastic material. However, one problem with thin or powder coatings is that they are often easily damaged. Any abrasion or other rough treatment could easily scratch the coating, negating the wettability effect and requiring repair.

It is one object of the present invention to provide a product having tailored wettability for water and other liquids which is able to retain its wettability functionality as a robust property.

According to one aspect of the present invention, there is provided a product which at least partly comprises an agglomerate formed from a powder having a pre-determined wettability.

Thus, the present invention provides a product which itself has the property of a certain wettability throughout that part of the product having the agglomerate, whereas WO 2008/035045 provides a powder whose surface coating has a property of a certain wettability. Thus, damage to the relevant surface of the product of the present invention does not negate or reduce the wettability property of the product; such property is retained by the product.

The agglomerate is an assemblage of the powder as a gathered mass forming a separate coherent identity to the powder, having a general particle size greater than that of the powder. In this way, removal of a portion of the agglomerate still provides a remainder of the agglomerate having the desired wettability. The removal of a portion of an agglomerate may be due to accidental damage or scratching, or by way of intentional abrasion to refresh the surface of the product.

The agglomerate may be formed from the powder using a suitable forming process having one or more steps. Such processes include compressing or tableting the powder into a larger mass and granulating the so-formed mass, spray-drying the powder under correct conditions, aggregating the powder, etc. In this way, the agglomeration provides an agglomerate comprising a collection or assemblage of individually coated powder particles held together by a force or sufficient force to have a coherent independent structure, but the removal of some of which from the agglomerate by a greater force such as abrasion does not reduce the wettability provided by the remainder of the agglomerate. Where the product or the outer layer of the product has a depth of the agglomerate, removal of some of the agglomerate again does not affect the wettability of the remainder.

The product may be formed into a pre-selected shape formed by the agglomerate which is at least part of the shape of the product, optionally wholly or substantially the shape of the product. The pre-selected shape formed by the agglomerate at least forms an outer layer extending at least partly across the surface of the product, optionally wholly or substantially across the surface of the product.

The present invention provides a product either being homogeneous or having at least a homogeneous outer layer extending across at least a part of the surface of the product, the homogeneous product or outer layer having a tailored wettability based on the wettability of the powder which is pre-determined.

Optionally, the homogeneous outer layer extends wholly or substantially across the whole surface of the product, such that the product wholly or substantially has a homogeneous tailored wettability.

The homogeneous outer layer has the property therethrough of a certain wettability based on the wettability of the agglomerate created by the powder. Generally, but not limited thereto, the wettability of the part or whole of the product comprising the agglomerate is wholly or substantially the same as the pre-determined wettability of the powder.

Because the outer layer has this homogeneous property, any damage to the uppermost part of this outer layer, generally equating to the product where it is a coating or to the surface of the product where the product is at least partly formed from the agglomerate, does not affect the continuing ability of the product to provide its tailored wettability. For example, physical damage such as scratching or abrasion, and/or chemical damage such as a surface reaction or etching, may affect one or more of the portions or layers of the formed agglomerates at the surface of the product, but removal of such portions or layers simply exposes one or more further portions or layers of the remaining parts of agglomerates having the pre-determined wettability, whose exposure as the new top surface of the product continues to provide the product with the wettability property.

Thus, the product of the present invention has that property of wettability throughout the extent of the shape and the depth of the product comprising the agglomerate. This may extend to a certain depth from the surface of the product, such as an agglomerate-based coating or a defined surface agglomerate layer, or optionally to the centre of the product where the product wholly or substantially comprises the agglomerate, such that the complete product has the homogeneous property of the tailored wettability.

One method of removing damaged layers is by the use of an abrasive, such as an abrasive paper many of which are known in the art. Rubbing the surface of the product with an abrasive paper is a simple and easy process, which is able to refresh at least that portion of the surface which is damaged, to provide the tailored wettability.

The product of the present invention thus retains its wettability functionality throughout the depth of the outer layer, surface or product comprising the agglomerate. The product is therefore hardwearing and robust against damage to the surface of the product unlike many surface coatings, which, once damaged and usually completely removed, expose the underlying substrate not having the desired wettability.

The product of the present invention has a particulate structure, such that accidental or deliberate removal of a portion or layer of particles at the surface provides exposure of a fresh portion or layer of particles with the tailored wettability.

The product of the present invention is generally cold-formed so as to preserve the wettability of the agglomerate and/or powder during forming.

In one embodiment of the present invention, the product is a free-standing or stand-alone product, able to exist as a separate entity compared to the agglomerate, and having a distinct shape compared to the agglomerate.

The powder may be formed into a shape through any shape forming process, generally comprising a mould or molding piece although not limited thereto, and optionally comprising some compaction of the powder. The shape forming process may be a distinct or continuous process.

One shape-forming process comprises compressing the agglomerate in a mould such as a die to form the shape of the mould. The shape of at least a portion of the product is thus pre-selected by the shape of the mould.

Methods of compressing an agglomerate are known to those skilled in the art. Such compression may be a single stage process, or a multi stage process. 'Solid' pre-selective shapes that can be formed by compaction include plates, bars, blocks, etc.

Another form of compression is forming a sheet, optionally after forming a thicker product shape, and subsequently compressing the thicker product shape through one or more sets of rollers.

The product may be partly, substantially or fully formed around one or more substrates, being the same or different. The substrate(s) could be metal and/or plastic, able to provide an inner shape, size, dimension and/or strength to the final product. The substrate(s) could also comprise a central portion of the product to reduce the amount of agglomerate required to form the product. In this way, the product can have a homogeneous outer layer provided by the agglomerate formed around the substrate(s), which outer layer extends across the surface of the product around the substrate(s), with the homogeneous outer layer having the tailored wettability.

Where the agglomerate is only partly formed around the substrate(s), such that at least a part of the surface of the product is the surface of the substrate(s), the surface of the product can be adapted to have one or more surface areas having a wettability different to the tailored wettability provided by the agglomerate having a pre-determined wettability.

In another embodiment of the present invention, the product is a coating. Thus, the agglomerate is, comprises or is useable as part of an agglomerate coating, such that the agglomerate can be applied to a surface or an article. In this way, the product can provide a surface layer comprising a thickness of the agglomerate able to be hardwearing and robust against damage to the surface, and having a depth of agglomerated powder able to retain its wettability functionality throughout the depth of the surface layer.

The present invention extends to an agglomerate formed from a powder having a pre-determined wettability as herein defined, as well as to the agglomerate being formed directly into a product or article, or being formed as the outer layer or surface of a product or article, or being applied to a surface of a distinct product or article as an agglomerated coating. Thus, the present invention extends to the use of such an agglomerate either directly as a product, or indirectly as a coating or as part of a coating formulation.

The product and/or agglomerate may also comprise one or more additional components. Such additional components may be to provide the product with one or more other properties, including strength, shape, size and dimensions. The or each additional property may be related to at least a part of the surface of the product, and/or within the product, and/or throughout the product.

For example, the product may comprise one or more other powders, optionally admixed with the agglomerate and/or powder having a pre-determined wettability, to provide the product with additional properties of the one or more other powders.

In another example, one or more adhesives are admixed with the powder having a pre-determined wettability, to provide adhesion of the agglomerate to comprise or form the product. For example, the one or more adhesives may be added to provide a shape-forming process, or to assist one or more shape-forming processes, or as part of a coating formulation comprising the agglomerate.

Examples of suitable adhesives are known in the art, and include well known polymers such as PVA and PMMA of certain grades, able to be activated by one or more forms of activation such as heat, light or other radical initiation. Activating adhesives are well known in the art. Other adhesives comprise or include various fluoroalkyl polymers, for example those available under the Zonyl® range from DuPont, such as Zonyl 8740.

A process used to form an agglomerate and/or a product of the present invention may reduce and/or deactivate the wettability of one or more parts of the surface of the agglomerate or product during its formation, compared to the wettability of the powder per se. For example, compression of the powder having a pre-determined wettability in a die may affect the wettability activity of the powder in contact with the die. Thus, a superhydrophobic powder may be compressed into a non-superhydrophobic product such as a disc or sheet.

In one embodiment to the present invention, the formed agglomerate or product is enhanced and/or activated to provide the tailored wettability of the present invention. The activation may involve one or more physical and/or chemical interactions with the surface, such as abrasion with a roughened surface, in order to remove the outermost layer of the agglomerate or product.

The whole surface of the agglomerate or product may be activated in this way, or only across one or portions of the surface of the product intended to have the tailored wettability, such as the intended 'top' or liquid-exposed side or sides. Thus, a product can be provided having a surface with a desired pattern or layout of tailored wettability.

The powder having the pre-determined wettability is preferably at least part-metallic, optionally being wholly or substantially (generally >50 mass %) metallic. Examples of suitable metals include iron, zinc, copper, tin, nickel and aluminium, and alloys thereof including steel, brass, bronze and nitinol. Metal powders such as copper powder are readily available materials.

By using an at least part-metallic powder, the product formed therefrom may wholly or substantially retain one or more of the properties of the metal. For example, where the powder is based on copper powder, the product formed therefrom may be at least partly ductile and/or malleable. The so formed product may also be useable like a metal, such as being able to be machined or worked or used like a metal.

The powder may have a pre-determined wettability as an inherent property thereof, of be adapted or modified to obtain the pre-determined wettability. One adaptation is to coat or layer the surface of a starter powder. The starter powder, having an at least part-metallic comprising a first metal, such as those listed herein above, could be coated with a surface having a pre-determined wettability.

One method of coating such a starter powder comprises the steps of:

(a) coating at least a part of the starter powder with a layer of a second metal to provide a metal-metal bonded surface, said surface being rough either prior to or because of step (a); and (b) contacting the metal-metal bonded surface of step (a) with a material to provide the surface having the pre-determined wettability.

The coating of at least part of the starter powder with a second metal can be carried out using any known process such as sputtering, any electrochemical method such as electrochemical deposition, a spontaneous redox reaction, or immersion.

Spontaneous electrochemical deposition methods usually require that the reduction potential of the first metal of the starter powder is more negative than the second metal ion to be deposited and coated on to the starter powder surface. Whether spontaneous or not, such a method requires that the starter powder to be coated is contacted with a solution of second metal ions, which ions are then reduced to the second metal at the surface.

As is known in the art, some electrochemical methods are spontaneous, some need to be driven.

For example, if gold or silver is to be deposited in a spontaneous redox reaction, then suitable first metals for the powder to be coated may be one or more of the group comprising: iron, zinc, copper, tin, nickel and aluminium, and alloys thereof including steel, brass, bronze and nitinol. In another example, platinum may be deposited on scandium or zinc.

Examples of products formable by the present invention include a metal sheet or a nozzle or instrument. Another example is one or more of the heat transfer sheets of a heat exchanger. For example, having a superhydrophobic transfer sheet for a water-based heat exchanger, such as involving steam, reduces or prevents the creation of a continuous condensation layer of the steam on the heat transfer sheet which inhibits continuing heat transfer from the steam to another medium. Meanwhile, any possible damage to the sheet due to the aggressive nature of the steam does not affect the superhydrophobic property of the sheet.

Other examples of suitable products of the present invention are separators or filters, generally intended to allow the passage of one material and prevent the passage of a second material, and in this way be a species-specific barrier material. For example, a superhydrophobic gas-permeable filter could allow the passage of gases such as air therethrough, whilst hindering the passage of water therethrough. In another example, a polar and non-polar liquid mixture such as water and oil or an organic solvent such as hexane could be passed through a filter having at least a part superhydrophobic surface, such that the water is rejected and the organic solvent passes therethrough and is therefore separated from the water. Again, any damage to the surface in use, such as by water erosion or turbulence, or the erosion caused by particles or substances in the water, would not affect the superhydrophobic property of the separator or filter.

Where the product is a coating, the coating may be used to coat any suitable article, and so provide the article with an agglomerate-based coating or surface having a robust wettability function greater than that of a powder-based coating.

The present invention is not limited by the use, shape, dimension or purpose of the product. The present invention allows such products to have or to provide a surface with a pre-determined wettability for any liquid (not limited to water).

The powder having the pre-determined wettability may be a solid metal powder, whose surface is therefore wholly metallic, or an at least partly, optionally fully, metal-coated powder of another substance such as glass or another ceramic or silicate. A powderous form of metal-coated glass beads is known in the art, and is useable with the present invention.

According to a further embodiment of the present invention, a starter powder is at least partly, optionally wholly, pre-coated with a third metal to provide the at least part-metallic surface of the starter powder suitable for the method of coating described hereinabove. One example is copper-plating a surface, to provide a suitable copper-surface starter powder. Copper can be plated on to many types, designs or arrangements of surfaces and substrates, whether being metallic, non-metallic or a combination of same. This includes ceramics, silicon and even other metal surfaces to which the direct coating with a layer of a second metal (to provide the metal-metal bonded surface of step (a) of the method described above) may be difficult.

Where the starter powder is non-metallic, the third metal becomes the first metal described hereinabove to provide the at least part-metallic surface comprising a first metal.

Thus, the third metal may be any suitable metal based on the properties of the starter powder to be covered. Preferably, the third metal is one or more of the group comprising: iron, zinc, copper, tin, tungsten, titanium, nickel and aluminium, and alloys thereof including steel, brass, bronze and nitinol.

The pre-coating of the starter powder with a third metal can be carried out using any known process such as sputtering, any electrochemical method such as electrochemical deposition, a spontaneous redox reaction, or immersion.

Immersing includes any form of dipping either at an ambient or a raised temperature. For example, galvanizing material, generally with zinc, is generally carried out by immersion of the powder in a bath of zinc at a temperature generally between 400°-500° C.

Other starter powders which could be pre-coated, including but not limited to copper, include steels such as stainless steel, metals such as tungsten, aluminium, titanium, and other alloys or substrates such as nitinol, ceramics, silicone, etc.

Some processes for the coating of step (a) will create a rough metal-metal bonded surface suitable for step (b), e.g. many electrochemical processes such as electrochemical deposition.

Processes such as sputtering or evaporative coating generally lay down an even layer of second metal on the powder being coated. Thus, where the coating process of step (a) does not inherently create a rough surface, roughening of the relevant part of the surface of the powder to be coated, to provide the rough surface for step (b), is required in advance of, i.e. prior to, step (a). Processes for roughening a powder surface are also well known in the art, and include chemical methods such as etching, and physical methods such as sand blasting or laser ablation.

The term "rough" as used herein relates to the microstructure of the metal-metal bonded surface (and the original surface of the powder where such surface needs to be roughened prior to step (a)). It is known that the wettability of solid surfaces with liquids is governed by the chemical properties and the microstructure of the surface, and the 'roughness' of the microstructure of the surface is known to enhance the wettable properties of a surface, increasing the ability of the present invention to tailor or pre-determine the desired wettability for the liquid concerned.

Preferably, the metal-metal bonded surface (and if necessary the original surface) has a 'double roughness', in the sense of having a first roughness structure on a microscale, for example 'clusters', 'stems', 'nodes', or 'flowers' or the like, usually sized between 100 nm and 100 μm, such as 0.15 μm to 1 μm, on which first roughness structure is a second roughness structure, being finer structures such as nanoscale extensions or protuberances of less than 30%, 20%, 10%, 5%, 2% or even 1% or less, of the size of the first roughness structure, such as is typical in a hierarchical lotus-leaf-like structure. The extensions of protuberances of the second roughness could be in the range 10 nm to 500 nm, such as 50 nm to 200 nm. Thus, there is preferably a double roughness to the metal-metal bonded surface for step (a).

The hierarchical double roughness structure of the lotus leaf is by way of illustration only, and the present invention is not limited to the actual shape or design of the first and second roughness structures. Accompanying Figures herewith show examples of first and second roughness structures. It is the relationship of the second roughness structure being smaller, usually significantly smaller, than the first roughness structure that provides the enhancement effect.

As mentioned hereinabove, some processes for the coating of step (a) will create a rough metal-metal bonded surface suitable for step (b) such as electrochemical deposition or electroless Galvanic deposition. The skilled person is aware that the concentration and timing of the chemical used for the process can affect the roughness created, and thus the wettability of the final surface provided by the invention.

The term "pre-determined wettability" as used herein relates to a powder whose surface has a minimum or maximum contact angle with a liquid. Where the liquid is water, the terms superhydrophobic and superhydrophilic can be used. A superhydrophobic surface can have a contact angle larger than 150°, preferably more than 160°, 170° or even 175°. For a superhydrophilic surface, the contact angle can be below 5°.

The term "tailored wettability" as used herein relates to providing a product having a desired minimum or maximum contact angle with a liquid. Where the liquid is water, the terms superhydrophobic and superhydrophilic can be used as defined above.

The same contact angle figures can be used for the wettability using other liquids such as organic materials, including solvents. Such liquids include for example hydrocarbons such as oil, petrol, benzene, as well as well known chemical solvents such as DMSO. The same test is used to determine their contact angle with a surface.

Step (b) of the coating method described above is preferably carried out at ambient pressure and temperature. Step (a) could also be carried out at ambient conditions, or conditions slightly above ambient. A slightly above ambient temperature can be less than 500° C., preferably less than 200° C., and preferably around or less than 100° C.

The present invention can also provide a product having two or more different surfaces with the same or different wettability. For example, the present invention can provide a product having a first area with a superhydrophobic surface, and a second area either without, within, or for example parallel to the first area, for a superhydrophilic surface, so as to direct, such as channel, water along a pre-determined path across the product. Other arrangements using phobic or philic areas to or for different solvents could provide other patterns on the product adapted to direct or channel different liquids.

The nature of the product is non-limiting, as the ability of the present invention is to provide a tailored wettability. This allows the invention to be capable of application to a wide range of different fields. By way of example only, the fields can include:

self-cleaning products for use in architectural cladding, roofing materials; automobiles and other forms of transport including aircraft and ships, garden furniture, metallic fencing and gates;

products for use in water environments such as ships to which the non-attachment of other components is desired, e.g. antifouling, or where reduction of contact with corrosive elements in the water, such as salt in sea-water, is desired;

products for use in water environments such as ships where minimization of resistance to movement through the water is desired;

products for use in moist environments such as marine or coastal locations where reduction of contact with corrosive elements in the air, such as salt in sea-water spray or air-borne sea-water, is desired;

biomedical products e.g. stents, catheters and wound dressings which can reduce or resist microbial infection and biofilm formation;

hollow tubes or conduits to minimize flow resistance in either microfluidic systems or conventional industrial and domestic pipework; and, hollow tubes or conduits to prepare optical waveguides which will conduct visible and uv light and may be used to transmit the light or as sampling systems for spectroscopy.

In general, the present invention provides a method of tailoring the wettability of at least part of the surface of a product or of a distinct article to suit the desired interaction thereof with a liquid. One liquid is water, but the present relates to all other liquids, including for example hydrocarbons and other organic compounds, especially solvents. Thus, the present invention also extends to, for example oleophobic and oleophilic surfaces for example.

The present invention provides a method of refining and/or amplifying the contact, such as the contact angle for a drop or droplet, between the liquid and the surface of the product. For a liquid such as water, there are the extremes of superhydrophobicity and superhydrophilicity. A product of the present invention may have a contact angle to any where between 0° and 180°, thus tailoring the wettability of the product to the desired requirement.

Preferably, the present invention provides either a product having or able to provide an at least partly, optionally fully, a superhydrophobic or a superhydrophilic surface.

For providing a superhydrophobic surface, the outer material of the powder could be one or more of the group comprising: thiols, nitriles, alkylamines, arylamines, phosphines, pyridines, pyrroles, and thiophenes.

Particularly suitable hydrophobic materials include:

Alkylthiols; Polyfluoroalkylthiols; Perfluoroalkylthiols; Arylthiols; Polyfluoroarylthiols; Perfluoroarylthiols; Alkylnitriles; Polyfluoroalkylnitriles; Perfluoroalkylnitriles Arylnitriles; Polyfluoroarylnitriles; Perfluoroarylnitriles; Alkylamines
Polyfluoroalkylamines; Dialkylamines; Polyfluorodialkylamines; Trialkylamines
Polyfluorotrialkylamines; Arylamines; Polyfluoroarylamines; Perfluoroarylamines
Diarylamines; Polyfluorodiarylamines; Perfluorodiarylamines; Triarylamines
Polyfluorotriarylamines; Mixed alkyl/arylamines; Mixed polyfluoro-alkyl/arylamines; Pyridine and pyridine derivatives; Pyrrole and pyrrole derivatives; Thiophene and thiophene derivatives; Alkylphosphines; Polyfluoroalkylphosphines; Dialkylphosphines; Polyfluorodialkylphosphines
Trialkylphosphines; Polyfluorotrialkylphosphines; Arylphosphines; Polyfluoroarylphosphines; Perfluoroarylphopshines; Diarylphosphines; Polyfluorodiarylphosphines; Perfluorodiarylphosphines; Triarylphosphines; Polyfluorotriarylphosphines; Mixed alkyl/arylphosphines; and Mixed polyfluoroalkyl/arylphosphines.

Suitable hydrophilic materials include:
Mercaptoalcohols; Mercaptophenols
Aminoalcohols; Aminophenols
Nitriloalcohols; Nitrilophenols
Nitriloamines; Aminophosphines
Hydroxyalkylpyridines; Hydroxyarylpyridines
Pyridine and pyridine derivatives; Pyrrole and pyrrole derivatives; and Thiophene and thiophene derivatives.

Chemicals and compounds having some ability to change the wettability of a surface are generally known to those skilled in the art. For example, chemicals or compounds generally having charged groups extending therefrom generally have or predicted to have a hydrophilic tendency. Similarly, chemicals or compounds having uncharged hydrocarbon groups extending therefrom are often, and can often predicted to be, hydrophobic. In this way, a chemical or compound having the same skeleton or basic structure, such as a thiophene can provide derivates which are hydrophilic and other derivates which are hydrophobic. It is the combination of the nature of the material on the rough metal-bonded surface of step (a), which can provide a powder with the surface having a pre-determined wettability.

Currently, there is no agreed definition for a "superhydrophilic" surface, especially due to the difficulty of measuring the contact angle of such a surface. A contact angle of <10° or <5° has been suggested in the art.

The present invention also provides a process for forming a product into an at least partly pre-selected shape with a tailored wettability comprising at least the step of:
forming a powder having a pre-determined wettability into the pre-selected shape.

Where required due to the forming process, one or more portions, optionally all, of the surface of the product are activated to provide such portion(s) with the tailored wettability.

In one embodiment of the present invention, a product is formed from an agglomerate of a powder having a superhydrophobic surface, said powder being formed from a starter powder having an at least part-metallic surface comprising a first metal, the first metal having a first reduction potential, comprising the steps of:
(a) contacting the first metal with an ionic metal solution, whose metal has a higher reduction potential (i.e. more positive or less negative reduction potential) than the first reduction potential, to provide a metal-coated surface;
(b) contacting the coated surface with a thiol material to provide a hydrophobic surface on the powder.

Strong bonding between the sulphur atom in the thiol material, and the metal which is deposited on the starter powder, creates a close packed self-assembled mono-layer, which gives the surface its hydrophobic nature, which nature can be characterized as superhydrophobic.

The metal of the ionic metal solution has a higher reduction potential than the reduction potential of the first metal of the starter powder. Such metals are known in the art, and two common examples are silver and gold, more particular silver (I) and gold (III) ions. Their ionic solutions can be provided by any number of known compounds, such as silver nitrate, silver sulphate, and various halogen-gold substances such as the chloroaurates.

The contacting of the powder with the second metal can be carried out by any known means including, but not limited to, dipping, brushing, spraying or the like. Dipping is simple and an easy method, wherein the powder is simply dipped into an ionic metal solution.

Because of the difference in reduction potential between the first metal of the starter powder and the metal of the ionic metal solution, there will generally be a redox reaction between the metals as is known in the art.

The thiol material is preferably a thiol solution: that is, any solution involving compound with a terminal SH group. Examples are the alkane thiols, such as preferably $C_{1-30+}$ straight or branched alkane thiols, preferably $C_{10-30+}$ alkane thiols, although many suitable aliphatic and aromatic thiol materials are also known.

In another embodiment of the present invention, the starter powder to be coated can be cleaned prior to step (a). The cleaning of powders with ketones such as acetone, alcohols such as absolute ethanol, etc, is well known in the art, generally to remove undesired materials from the surface of the powders.

In another embodiment of the present invention, the starter powder to be coated is etched prior to step (a). Etching is a well known process, and is usually carried out by an acid, in order to create an etched surface.

Preferably, the metal of the second metal is deposited on the relevant surface of the starter powder in a uniform manner, although non-uniformed deposition may still be desired in certain circumstances, and is still within the scope of the method. Variation in the volume, depth, degree or uniformity of the second metal onto the surface of the powder can be varied by any number of means, such as the degree of cleaning or etching prior to step (a), the parameters of the contacting of second metal and the powder surface, or environmental factors.

The variables of deposition of a metal onto a surface are known in the art. For example, the contacting by dipping of a powder such as zinc or copper in a silver nitrate solution can be carried out in a number of minutes, the number of minutes usually depending upon the concentration of the solution. The higher the solution concentration, the less contacting time required for the same coating.

In another embodiment of the present invention, between steps (a) and (b), the metal surface of the starter powder is preferably washed and dried prior to contacting it with the next material. The drying can be carried out in many ways known in the art, including the provision of heating. Preferably, the drying is carried out by the use of a compressed gas such as compressed air, which is able to minimize physical engagement (for example to minimize dirt residue forming on the second metal), and to ensure a more uniform deposition layer of the second metal. If the coated surface is dried by physical contact with another material, such contact may affect the coated surface and therefore affect the final surface following step (b). This may be desired in certain circumstances.

The product provided by the present invention could also be used in water, or another marine environment such as around sea-water or other moist air. Where the product is superhydrophobic, it may reduce the ability of corrosive substances in water or carried in moist air to contact the product, reducing corrosion or the rate of corrosion. For example, parts of a bridge, being underwater or above water, could be formed by the present invention to reduce corrosion.

Another example of the present invention is a planar microfluidic device, which can optionally be patterned by forming around a substrate to provide areas or channels of different wettability. It could also be patterned by stamping to create physical channels which have the same wettability, such as superhydrophobicity, as surrounding parts.

Further examples of use of the present invention are conduits or pipes having an internal superhydrophobic surface, such that flowing water or water-based fluids have minimal contact with the container walls due to the air layer, reducing friction in turbulent flows.

Figure 2:
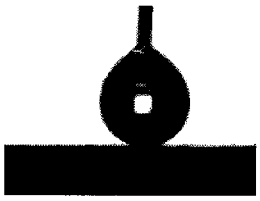
Figure 3:
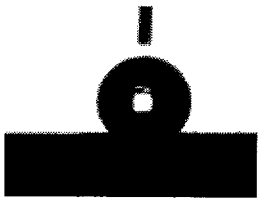
Figure 4:
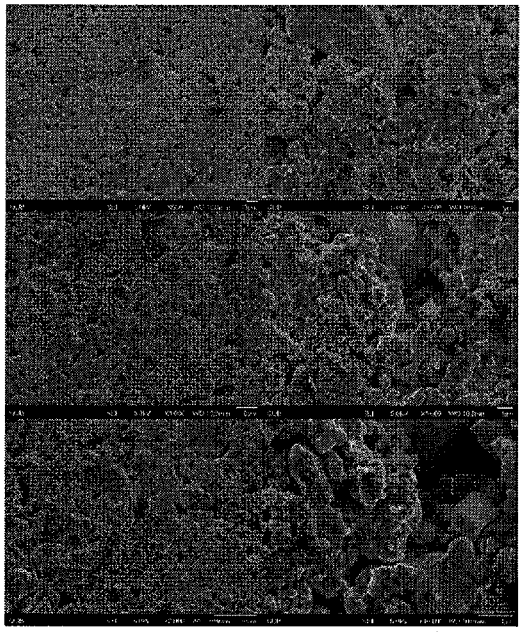
Figure 5:
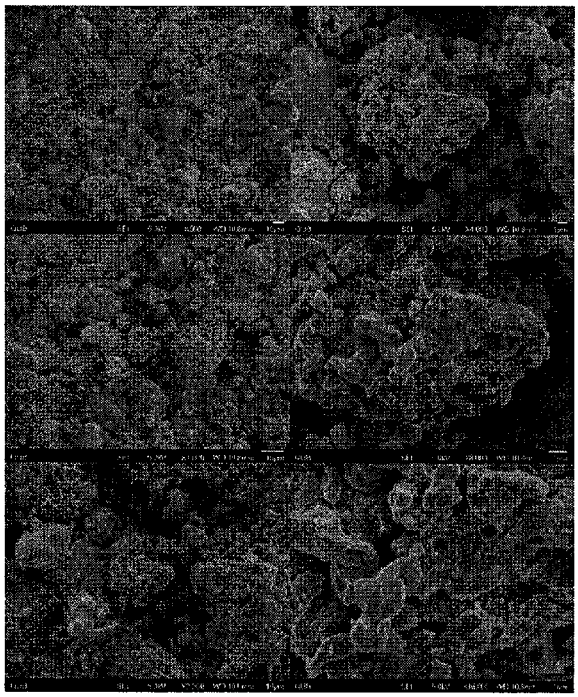
Figure 6:
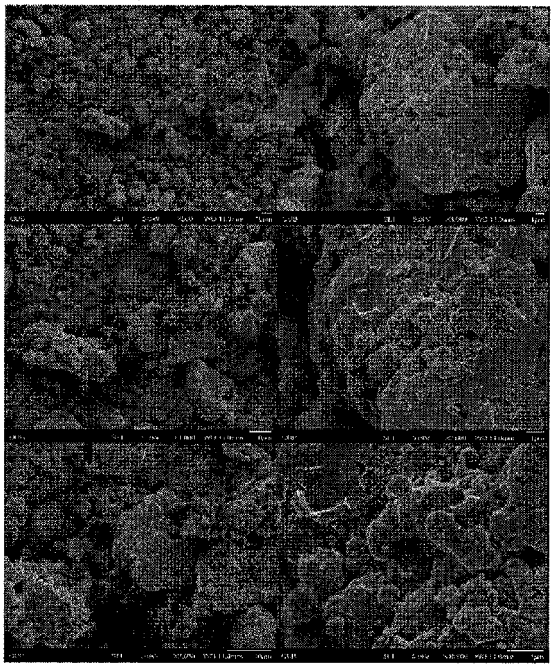

Examples and embodiments of the present invention will now be described by way of example only, and with reference to the accompanying drawings in which:

FIGS. 1, 2, and 3 are side views of a water droplet on a copper-based disc formed according to one embodiment of the present invention at different pressures, showing the contact angle therebetween;

FIG. 4 comprises 6 SEM images of a 2.5 ton disc of compressed powder requiring activation, at different resolutions;

FIG. 5 comprises 6 SEM images of the 2.5 ton disc of FIG. 4 at different resolutions after activation; and FIG. 6 comprises 6 SEM images of the 2.5 ton disc of FIG. 2 at different resolutions after being deliberately damaged by scratching.

EXAMPLE 1

Step 1

40 g of three different copper powders (having general particles sizes 475 μm, <75 μm and <10 μm, all available from Aldrich) was weighed out and washed with 0.5% $HNO_3$, filtered and washed with deionized water. 70 mls of 0.02M $AgNO_3$ was added to the flask and the powder shaken over several minutes. The powder was filtered and washed before being placed in an oven at 70° C. until dry. Then 100 ml of a 0.1M decanethiol solution in ethanol was added on top of the powder and the whole shaken. This was left overnight before being filtered and washed with clean ethanol. It was then placed back in the oven until dry.

The skilled person in the art is aware that the exact concentrations, weight of powder, size of powder and treatment times can be varied over many ranges of combinations.

Step 2

Approximately 1 g of the <75 μm powder was placed into a 13 mm diameter table die, and then subjected to three different pressures of 1 ton, 2.5 ton and 5 ton. The pressure was released and the resulting disk removed as preformers. Each disk was mechanically abraded with Kingspor 100 grit abrasive paper, and contact angle tested with water.

FIGS. 1, 2, and 3 show side views of the location of a water droplet on each of these surfaces, and the below Table 1 thereafter confirms the contact angles measured for each disc.

TABLE 1

Contact angles of discs:

| Pressure/Tonnes | Contact Angle Mean/° | Contact Angle s.d./° |
|---|---|---|
| 1 | 150.3 | 0.8 |
| 2.5 | 153.1 | 1.5 |
| 5 | 132.7 | 1.4 |

FIG. 4 shows 6 SEM images at different magnifications of the 2.5 ton post-die performer, showing the deactivation of the surface due to the surface compression of the powder in the die.

The 6 SEM images shown in FIG. 5 are different magnifications of the surface of the 2.5 ton formed disc of FIG. 4 once abraded, to provide the disc shown in FIG. 2. The surface of the disc is made up of "stalks" ranging in diameter from 0.75 to 2 μm. Each of these "stalks" has smaller particles thereon which are approximately 100 to 200 nm; this is thus a double roughness scheme which gives superhydrophobicity.

FIG. 6 shows SEM images of the same product of FIG. 5 at different magnifications, after repeated scratches were applied thereto by a sharp instrument. It can be seen that there is no difference to the surface, such that the superhydrophobic effect still applies to the product surface. In particular, damage to the surface of such a disc, including repeated deep scratches, makes no change, as the superhydrophobic property extends homogeneously throughout the disc.

These products can also be used in sensing applications, the self-assembled monolayer providing a simple route for the introduction of a wide range of functionality. This combined functionality and perfect hydrophobicity can be incorporated into lab-on-a-chip applications. Flow cells until now have generally been made of a plastic, however changing them to a metal base will allow these perfectly hydrophobic surfaces to be utilised in this application for example by using part-coated or featured surfaces to guide liquids in hydrophilic channels bounded by hydrophobic walls.

EXAMPLE 2

A silver layer was electrolessly deposited using silver nitrate on a starting copper (200 mesh) powder, followed by drying the powdered product. The powder was then treated with 3,3,4,4,5,5,6,6,7,7,8,8,9,9,10,10,10-Heptadecafluoro-1-decanethiol (HDFT) to give a superhydrophobic powder.

The powder was then mixed with a Zonyl 8740 30% solution (weight ratio 2:1 powder:Zonyl solution) adhesive and the liquid mixture was then applied to a planar glass plate. Subsequent drying at 70° C. yielded a material with a water contact angle of 153° (±1°).

FURTHER EXAMPLES

Examples of powders having a surface with a tailored or pre-determined wettability that have been prepared for use in accordance with the present invention include those using:

1. Copper, gold and fluoro-thiol.
2. Copper, silver and 1-decanethiol.

The source of silver ions for these compounds was silver nitrate.

The accompanying Table 2 shows the contact angle values of various surfaces for particular metal surfaces per se, and then for powders for use in forming products of the present invention. The range of contact angle values in the table show powders able to provide a wettability between superhydrophobic and superhydrophilic i.e. tailored wettability, between the two extremes. The table also shows examples of pre-roughening metallic powders by wet acid etching them, and then gold coating the roughened surfaces before thiol treatment. These again show tailored wettability as the wettability can change depending on preparation method.

The first six entries in Table 2 show the contact angle for six example metals. Thereafter, different variations of metal, etching, second metal and material thereon to provide the relevant final or top surface are shown, along with the contact angle of each such surface. For example, copper with a second metal of silver and a 6-mercapto-1-hexanol (6 MH1) material provides a superhydrophilic surface, whilst copper with a pre-etching with hydrochloric acid, a second metal of silver and a HDFT material, provides a contact angle that could be defined as superhydrophobic.

Similarly, <75 um copper powder has a contact angle of 129°, whereas with pre-etching the same powder with nitric acid, and adding a second metal of silver and a decanethiol layer thereon, provides a surface with a contact angle of 152°. A range of thiol-based materials such as alkylthiols, arylthiols and mercapto acids again provide variation in contact angle. Table 2 then shows variation in contact angle based on variation in etching time for various acids and metallic surfaces with the same second metal and top material layer.

Table 2 relates to contact angle with water, but the skilled person in the art is aware of using the same criteria with other liquids.

TABLE 2

| First metal | Etching Time/acid | Second metal | Top material | Contact Angle (°) | S.D. |
|---|---|---|---|---|---|
| Zinc | — | — | — | 93.431 | 1.916 |
| Copper | — | — | — | 96.896 | 0.491 |
| Silver | — | — | — | 73.459 | 3.156 |
| Gold | — | — | — | 76.282 | 1.656 |
| Titanium | — | — | — | 83.570 | 1.382 |
| Iron | — | — | — | 82.253 | 2.018 |
| Zinc | 2 min 4M HCl | Ag | 6MH1 | 25.965 | 3.287 |
| Copper | — | Ag | 6MH1 | 2.767 | 0.842 |
| Zinc | 2 min 4M HCl | Au | HDFT | 159.796 | 1.032 |
| Zinc | 2 min 4M HCl | Ag | HDFT | 173.260 | 0.837 |
| Copper | — | Ag | HDFT | 172.903 | 1.490 |
| <75 um Cu powder | — | — | — | 129.244 | 1.982 |
| <75 um Cu powder | 0.5% $HNO_3$ | Ag | decanethiol | 152.690 | 1.209 |
| <10 um Cu powder | — | — | — | 117.484 | 0.730 |
| <10 um Cu powder | 0.5% $HNO_3$ | Ag | decanethiol | 152.572 | 2.372 |
| Zinc | 2 min 4M HCl | Ag | pentanethiol | 154.894 | 0.634 |
| Zinc | 2 min 4M HCl | Ag | hexanethiol | 155.181 | 0.744 |
| Zinc | 2 min 4M HCl | Ag | octanethiol | 157.137 | 1.557 |
| Zinc | 2 min 4M HCl | Ag | decanethiol | 157.397 | 0.651 |
| Zinc | 2 min 4M HCl | Ag | hexadecane thiol | 161.500 | 1.398 |
| Zinc | 2 min 4M HCl | Ag | benzenethiol | 133.529 | 1.916 |
| Zinc | 2 min 4M HCl | Ag | pentafluoro thiophenol | 127.252 | 1.160 |
| Zinc | 2 min 4M HCl | Ag | 4-methyl benzenethiol | 134.792 | 2.211 |
| Zinc | 2 min 4M HCl | Ag | 4-trifluoro methylthio phenol | 150.751 | 2.140 |
| Zinc | 2 min 4M HCl | Ag | 2-methyl benzenethiol | 133.351 | 2.736 |
| Zinc | 2 min 4M HCl | Ag | 3-methyl benzenethiol | 125.942 | 1.230 |
| Zinc | 2 min 4M HCl | Ag | 4-methoxy benzenethiol | 128.692 | 4.686 |
| Zinc | 2 min 4M HCl | Ag | cyclohexane thiol | 156.010 | 1.009 |
| Zinc | 2 min 4M HCl | Ag | cyclopentane thiol | 156.450 | 1.276 |
| Zinc | 2 min 4M HCl | Ag | 16-mercapto hexadecanoic acid | 159.560 | 1.027 |
| Zinc | 2 min 4M HCl | Ag | 3-mercapto propionic acid | unmeasureably small | |
| Zinc | 1 min 4M HCl | sputtered Au | HDFT | 139.368 | 2.928 |
| Zinc | 2 min 4M HCl | sputtered Au | HDFT | 142.162 | 2.540 |
| Zinc | 3 min 4M HCl | sputtered Au | HDFT | 144.676 | 0.921 |
| Zinc | 4 min 4M HCl | sputtered Au | HDFT | 146.997 | 1.261 |
| Zinc | 8 min 4M HCl | sputtered Au | HDFT | 148.608 | 2.608 |
| Zinc | 12 min 4M HCl | sputtered Au | HDFT | 127.802 | 1.546 |
| Zinc | 16 min 4M HCl | sputtered Au | HDFT | 123.813 | 1.211 |
| Titanium | 10 sec 10% HF | sputtered Au | HDFT | 118.125 | 3.982 |
| Titanium | 20 sec HF | sputtered Au | HDFT | 116.575 | 1.207 |
| Titanium | 30 sec HF | sputtered Au | HDFT | 117.471 | 1.832 |
| Titanium | 60 sec HF | sputtered Au | HDFT | 135.483 | 1.503 |
| Titanium | 2 min HF | sputtered Au | HDFT | 115.299 | 1.251 |
| Titanium | 4 min HF | sputtered Au | HDFT | 114.166 | 1.055 |
| Titanium | 6 min HF | sputtered Au | HDFT | 111.819 | 0.771 |
| Iron | 1 min 37-38% HCl | sputtered Au | HDFT | 124.234 | 1.758 |
| Iron | 2 m HCl | sputtered Au | HDFT | 126.435 | 3.722 |
| Iron | 3 min HCl | sputtered Au | HDFT | 139.802 | 2.238 |
| Iron | 4 min HCl | sputtered Au | HDFT | 140.682 | 1.295 |
| Iron | 8 min HCl | sputtered Au | HDFT | 122.878 | 1.166 |
| Iron | 5 min 70% HNO3 | sputtered Au | HDFT | 114.874 | 2.770 |
| Iron | 10 min HNO3 | sputtered Au | HDFT | 103.498 | 1.276 |
| Iron | 15 min HNO3 | sputtered Au | HDFT | 94.744 | 2.722 |
| Iron | 20 min HNO3 | sputtered Au | HDFT | 109.961 | 1.967 |

The invention claimed is:

1. A product having at least partly a superhydrophobic surface, which surface at least partly comprises a plurality of agglomerate particles, wherein each agglomerate particle is a gathered mass of powder particles having a pre-determined wettability, wherein the pre-determined wettability is superhydrophobic and the powder has a contact angle with water of greater than 150°, and wherein the surface retains its superhydrophobic functionality throughout a depth of the agglomerate particles comprising the surface.

2. A product as claimed in claim 1 wherein the product has a pre-selected shape formed by the agglomerated powder.

3. A product as claimed in claim 2 wherein the agglomerate at least forms an outer layer extending partly, wholly or substantially across the surface of the product.

4. A product as claimed in claim 1, wherein the product is or has a homogeneous outer layer having a homogeneous tailored wettability.

5. A product as claimed in claim 4, wherein the tailored wettability of the part or whole of the product comprising the agglomerate is wholly or substantially the same as the predetermined wettability of the powder.

6. A product as claimed in claim 1, wherein the product is cold-formed so as to preserve the wettability of the agglomerate and/or the powder during forming.

7. A product as claimed in claim 1, wherein the product is a free-standing or stand-alone product.

8. A product as claimed in claim 1, wherein the surface of the product is adapted to have one or more surface areas having a wettability different to the wettability provided by the agglomerate.

9. A product as claimed in claim 1, wherein the product is a coating.

10. A product as claimed in claim 1, wherein the agglomerate comprises one or more additional components, including one or more other powders.

11. A product as claimed in claim 10 wherein an additional component comprises one or more adhesives to provide adhesion of the agglomerate to form the product.

12. A product as claimed in claim 1, wherein the powder is >50 mass % metallic, comprising one or more of the group comprising: iron, zinc, copper, tin, nickel and aluminium, and alloys thereof including steel, brass, bronze and nitinol.

13. A product as claimed in claim 1, wherein the agglomerate is at least partly formed by pressing the powder together.

14. A process for forming a product as defined in claim 1, comprising at least the step of:

pressing the powder into the shape of the product or around a substrate to form the agglomerated product.

15. A process for forming an agglomerate, said agglomerate having a superhydrophobic surface, said process comprising the steps of:

providing a starter powder having an at least part metallic surface comprising a first metal, the first metal having a first reduction potential;

contacting the first metal with an ionic metal solution, whose metal has a higher reduction potential (i.e., more positive or less negative reduction potential) than the first reduction potential, to provide a metal-coated surface;

contacting the metal-coated surface with a thiol material to provide a superhydrophobic surface on the powder, wherein the superhydrophobic surface has a contact angle with water of greater than 150°; and agglomerating the powder to form a plurality of agglomerate particles, wherein each agglomerate particle is a gathered mass of powder particles.

* * * * *